US007735958B2

(12) United States Patent
Murayama

(10) Patent No.: US 7,735,958 B2
(45) Date of Patent: Jun. 15, 2010

(54) INK JET RECORDING APPARATUS

(75) Inventor: Yasushi Murayama, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 753 days.

(21) Appl. No.: 11/556,814

(22) Filed: Nov. 6, 2006

(65) Prior Publication Data

US 2008/0012896 A1 Jan. 17, 2008

(30) Foreign Application Priority Data

Nov. 8, 2005 (JP) ..... 2005-323900

(51) Int. Cl.
*B41J 2/165* (2006.01)

(52) U.S. Cl. ..... 347/33; 347/31; 347/32

(58) Field of Classification Search ..... 347/33, 347/29, 30, 32, 31
See application file for complete search history.

(56) References Cited

U.S. PATENT DOCUMENTS 7,344,223 B2 * 3/2008 Ishikawa et al. ..... 347/33
2005/0007412 A1 1/2005 Nishikawa et al.

FOREIGN PATENT DOCUMENTS

EP 1 405 725 A1 * 4/2004
JP 6-234221 A * 8/1994 ..... 347/33

* cited by examiner

*Primary Examiner*—shih-wen hsieh
(74) *Attorney, Agent, or Firm*—Fitzpatrick, Cella, Harper & Scinto

(57) ABSTRACT

An ink jet recording apparatus for effecting recording on a recording material by ejecting ink from an array of ejection outlets provided in an ejection side surface of a recording head, includes a cleaning mechanism, including an absorbing member for absorbing and removing the ink deposited on the ejection side surface, for cleaning the ejection side surface by moving the absorbing member in contact with the ejection side surface in a direction in which the array of the ejection outlets extends; wherein the absorbing member comprises a plurality of absorbing materials having average pore sizes different from each other and contacted with each, and an absorbing material having a larger average pore size is contacted to the ejection outlet to absorb the ink.

7 Claims, 10 Drawing Sheets

INK JET RECORDING APPARATUS

FIELD OF THE INVENTION AND RELATED ART

The present invention relates to an ink jet recording apparatus which records an image by jetting ink onto recording medium from ink jetting openings with which one of the surfaces of the recording head is provided. In particular, it relates to an ink jet recording apparatus equipped with a cleaning apparatus for cleaning the abovementioned surface of the recording head, which has the ink jetting openings.

A recording apparatus, which has the functions of a printer, a copying machine, a facsimile machine, etc., is structured to record an image (characters, symbols, etc.,) on recording medium, such as paper, fabric, plastic sheet, or OHP sheet, based on picture information. There are two types of recording method, that is, the serial and line types. In the recording method of the serial type, an image is recorded by alternately repeating the operation for moving a recording head along the surface of the recording medium in the primary scan direction, and the operation for conveying the recording medium in the secondary scan direction. In the recording method of the line type, an image is recorded with a use of a long recording head, which extends in the width direction of the recording medium, long enough to reach from one end of the recording medium to the other, in terms of the width direction of the recording medium. Therefore, when an image is recorded with the use of the recording method of the line type, only the recording medium is moved (in the secondary scan direction) while recording is made all at once across the entire image formation range of the recording medium from one end of the recording medium to the other end, in terms of the width direction of the recording medium.

There are various types of recording apparatus which have been in use. One of such recording apparatus is an ink jet recording apparatuses, which records an image on recording medium by selectively causing the multiple ink jetting openings, with which the ink jetting surface of the recording head is provided, to jet ink. Since an ink jet recording apparatus records an image by causing ink droplets to fly out from microscopic openings, the ink mist is generated as ink is jetted, and/or as ink droplets splash when they hit the recording medium. The microscopic floating ink droplets, and the like, which make up these ink mists, sometimes collect and coagulate on the ink jetting surface of the recording head, turning into adherent ink residue. Further, in order to prevent the ink jetting openings from being plugged up by the adherent ink residue, and also, in order to remove the bubbles and abnormally viscous ink, which occur in the ink jetting nozzles, the so-called performance restoration operation is carried out; the ink in the ink jetting nozzles is discharged from the ink jetting openings to fill the nozzles with a fresh supply of ink. More specifically, the ink in a recording head is circulated with the application of pressure, or the ink is suctioned out of a recording head through the ink jetting openings by applying negative pressure to the ink jetting surface. This performance restoration operation also sometimes allows ink to adhere to the ink jetting surface.

The ink residue such as the above described one is likely to change a recording apparatus in ink droplet trajectory, and/or cause the recording head to jet ink in an improper manner, reducing thereby the recording apparatus in image quality. In order to prevent these problems, it is necessary to carry out a cleaning operation for removing the foreign substances, such as the ink residue, having adhered to the ink jetting surface of the recording head. In such a cleaning operation, the foreign substances are removed by moving a cleaning member in the direction in which the ink jetting openings are arranged, while keeping the cleaning member in contact with the ink jetting surface. As one of the means for cleaning the ink jetting surface, a wiping member has been used, which is for wiping the ink jetting surface to remove (wipe away) the ink residue having adhered to the ink jetting surface. There has been also used an absorbent member, such as a roller formed of absorbent substance, which is for removing the ink residue having adhered to the ink jetting surface, by absorbing the ink residue.

However, cleaning apparatuses in accordance with the prior art suffered from the following technical problem. That is, as the operation for absorbing the ink residue on the ink jetting surface to remove the ink residue from the ink jetting surface is repeated, the ink absorbing member was likely to quickly reduce in ink absorbency, for the following reason. That is, although a portion of the absorbent member, which does not come into contact with the ink jetting surface, remain sufficiently absorbent, a portion of the absorbent member, which comes into contact with the ink jetting openings and their adjacencies, is quickly saturated with the absorbed ink, quickly declining in ink absorbency, in the early stage of the cleaning operation. This problem is more pronounced in the case of a recording head of the full-line type, for the following reason. That is, a recording head of the full-line type is greater in the number of ink jetting orifices, and also, is greater in ink jetting surface size. Therefore, even if it is equipped with both an absorbent member and a wiping member, it was difficult to keep the absorbent member sufficiently absorbent for a long time. Further, as the absorbent member becomes saturated with the absorbed ink, the portion of the ink on the ink jetting surface, which the absorbent member failed to absorb, laterally and rearwardly spread beyond the cleaning (wiping) range of the wiping member, making it impossible for the cleaning apparatus to cleaning the ink jetting surface.

SUMMARY OF THE INVENTION

The primary object of the present invention is to provide an ink jet recording apparatus in which the ink absorption performance of its absorbent member is kept at a satisfactory level for efficiently absorbing ink to remove the ink while absorbing the ink having adhered to the ink jetting surface of the recording head.

Another object of the present invention is to provide an ink jet recording apparatus, which records an image on recording medium by jetting ink from ink jetting openings, with which the ink jetting surface of the recording head is provided, and which is characterized in that it has a cleaning mechanism, which has an absorbent member for absorbing the ink having adhered to the abovementioned ink jetting surface to remove the ink, and cleans the ink jetting surface by moving the absorbent member in the direction in which the ink jetting openings are arranged, while keeping the absorbent member in contact with the ink jetting surface, and also, in that the absorbent member is made up of multiple absorbent sections different in average pore diameter, and an absorbent section, which is larger in average pore diameter is placed in contact with the abovementioned ink jetting surface to absorb the ink thereon.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Figure 1:
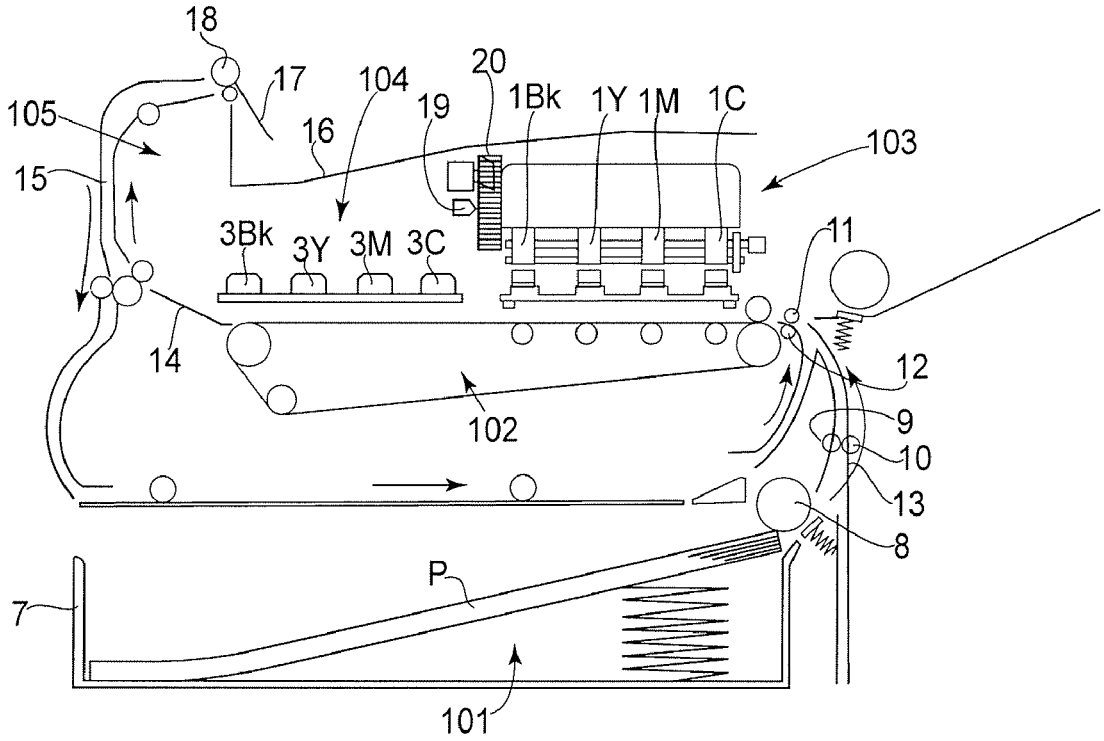
FIG. 1 is a vertical sectional view of the ink jet recording apparatus in the first embodiment of the present invention.

Hereinafter, the preferred embodiments of the present invention will be concretely described with reference to the appended drawings. Incidentally, if a component, section, or the like, in one of the appended drawings is designated by the same referential symbol used in another drawing to designate a component, section, or the like, the two correspond to each other. FIG. 1 is a vertical sectional view of the ink jet recording apparatus in the first embodiment of the present invention. In FIG. 1, designated by a referential symbol 7 is a sheet feeder cassette, and designated by a referential symbol 8 is a pickup roller. Designated by referential symbols 9 and 10 are conveyance rollers. Designated by referential symbols 11 and 12 are registration rollers. Designated by a referential symbol 13 is a conveyance guide 13, which is on the recording medium entrance side. Designated by a referential symbol 14 is a conveyance guide for two-sided recording, and designated by a referential symbol 15 is a conveyance guide, which is on the recording medium exit side. Designated by referential symbols 16, 17, and 18 are a delivery tray, a sheet directing flap, and a sheet discharging roller, respectively. Designated by a referential symbol 19 is a sensor for detecting the vertical movement of the recording head, and designated by a referential symbol 20 is a rack for vertically moving the recording head.

The sheet feeder cassette 7 makes up a part of a sheet feeding station 101. The recording mediums P, such as sheets of recording paper, stored in the sheet feeder cassette 7 of the sheet feeding station are fed, as necessary, into the main assembly of the recording apparatus, by the pickup roller 8, while being separated one by one, and are conveyed to a sheet conveying device 102 of the belt type. While each recording medium is conveyed by the sheet conveying device 102, an image (inclusive of letters, symbols, etc.,) is recorded on the recording medium. After the recording of the image on the recording medium, the recording medium is sent into the tray 16 through a sheet discharging portion 105. The recording apparatus shown in FIG. 1 is for recording a color image, and its image forming section 103 has four recording heads 1C, 1M, 1Y, and 1Bk held by a head holder 4. Each recording head is of the line type, and its ink jetting surface is provided with multiple ink jetting openings 2*a*, which are arranged at a preset pitch. The number of the ink jetting openings 2*a* is large enough to extend from one edge of the recording medium to the other, in terms of the width direction of the recording medium P.

Designated by a referential symbol 104 is a capping portion, which makes up a part of the recovery unit for maintaining and/or restoring the ink jetting performance of the recording heads 1. The capping portion 104 is provided with four caps 3C, 3M, 3Y, and 3Bk for capping the ink jetting openings 2*a* of the ink jetting surface of the recording heads 1C, 1M, 1Y, and 1Bk, respectively. Each cap 3 also has the function of reducing the ink evaporation from the ink jetting openings 2*a*, and protecting the ink jetting openings 2*a*. Incidentally, FIG. 1 shows the recording apparatus, which is ready for recording an image, and in which its capping portion 104 has been retracted (separated) from the image forming portion 103.

Figure 2:
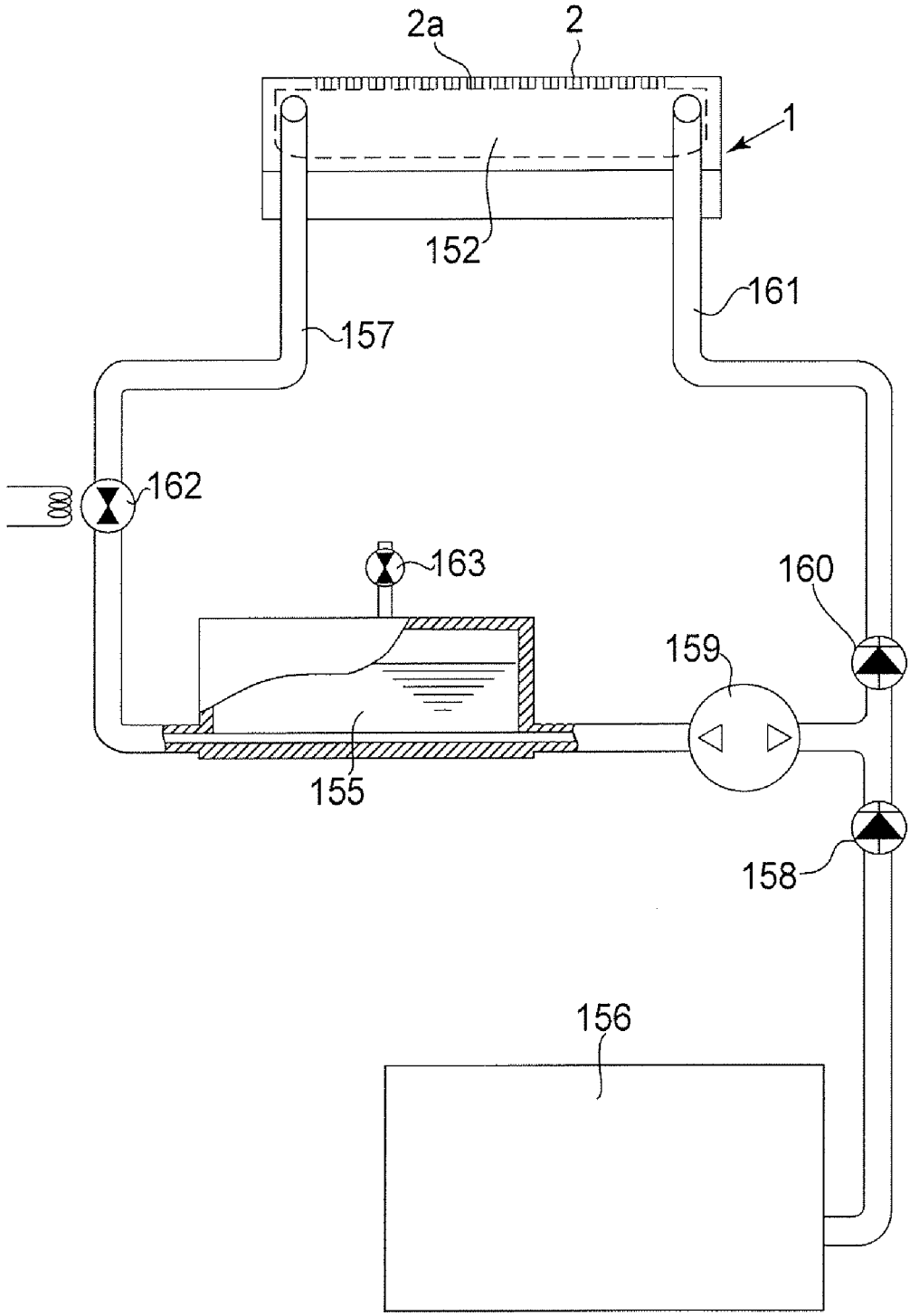
FIG. 2 is a block diagram of the system for supplying each recording head of the ink jet recording apparatus, shown in FIG. 1, with ink, and the pressure application system for restoring the recording head performance by circulating ink through the ink supplying system by pressure application.

FIG. 2 is a block diagram showing the ink supplying system of the recording apparatus showing in FIG. 1, which is for supplying each of the multiple recording heads 1 with ink, and the recording performance recovery system of the recording apparatus, which is for restoring the recording performance of each recording head by circulating ink through the ink supplying system by pressure application. In FIG. 2, the ink jetting surface 2*a* of the recording head 1 is provided with the multiple ink jetting openings 2*a*, which are arranged at a preset pitch. Each ink jetting opening 2*a* is connected to a common liquid chamber 152 in the recording head. The multiple ink jetting openings are evenly distributed from one end of the recording head 1 to the other, in terms of the width direction of the recording medium, enabling the recording head 1 to record all at once across the entirety of the recordable range of the recording medium, from one end of the recording medium P to the other, in terms of the width direction of the recording medium P. Therefore, this recording apparatus can record an image in entirety, without moving the recording heads, that is, simply by selectively driving the heat generating elements placed in the liquid passages, which lead to the ink jetting openings.

Designated by referential symbols 155 and 156 are a subordinate ink container for supplying the recording head 1 with ink, and a main ink container for supplying the subordinate ink container 155 with ink, respectively. During an image forming operation, an electromagnetic valve 162, with which an ink supply line 157 is provided, is kept open to allow the ink in the subordinate ink container 155 to be supplied to the common liquid chamber 152 through the ink supply line 157. The subordinate ink container 155 is supplied with the ink sent by a pump 159 from the main ink container 155 through a one-way valve 158. Designated by a referential symbol 160 is a one-way valve, which is used for the performance restoration operation for restoring ink jetting function of the recording head 1. Designated by a referential symbol 161 is a recirculation line, which has the one-way valve 160. The subordinate ink container 155 is provided with an air bleeding valve 163.

Referring to FIG. 2, during an image forming operation, the electromagnetic value 162 is kept open to allow the ink in the subordinate ink container 155 to be supplied by its own weight to the common liquid chamber 152, from which the ink is led to each ink jetting opening 2*a* through the corresponding liquid passage. Also during an image forming operation, the performance restoration operation is carried out for the purpose of not only removing the bubbles remaining in the recording head 1 and/or ink supplying system, but also, cooling the recording head 1. This type of performance restoration operation is an operation in which ink is recirculated by the application of pressure; the pump 159 is driven to send ink into the common liquid chamber 152 through a recirculation line 161, and then, return the ink from the common liquid chamber 152 to the subordinate ink container 155 through the ink supply line 157. This type of performance restoration operation is for unplugging the ink passages to the ink jetting openings, by discharging, by a small amount, the body of ink, which is being recirculated.

When filling the recording head 1 with ink for the first time, the pump 159 is driven, with the electromagnetic valve 162 kept closed, so that ink is sent to the common liquid chamber 152 through the recirculation line 161 in order to jet ink, along with bubbles, through the ink jetting openings 2*a*. When a recording apparatus is not used for recording, its recording heads are often left as they are, that is, with ink remaining in the ink passages leading to the ink jetting openings. Thus, when a recording apparatus is not used for recording, a capping operation is carried out; a cap is pressed upon the ink jetting surface 2*a* to seal the ink jetting opening 2*a*. With the ink jetting openings 2*a* sealed from the ambience by capping, the air in the cap is saturated with ink vapor. As a result, the ink in each ink passage leading to the corresponding ink jetting opening 2 is prevented from evaporating and/or increasing in viscosity, by the saturation vapor pressure of the ink at the time of capping.

However, it is possible that while an ink jet recording apparatus is left unused in a low humidity environment, or for a long period, the ink in the recording head will increase in viscosity, even the ink jetting surface 2 is left capped (sealed) with the cap left pressed upon the ink jetting surface 2. Thus, an ink jet recording apparatus sometimes completely fails to jet ink, or jet ink in a proper manner, failing therefore to normally record, when it is used for recording for the first time (with the cap removed), after a long period of no usage. In order to solve this problem, both the above described performance restoration operation, in which ink is jetted from all the ink jetting openings by recirculating the ink by driving the pump 159, shown in FIG. 2, and the following performance restoration operation described next. That is, when the decline in the ink jetting performance of the recording heads is relatively slight, the energy generating means in all the ink jetting nozzles of a recording apparatus are driven to jetting ink, that is, ink is jetted based on the same mechanism as that based on which ink is jetted in an normal recording operation. In this patent application, this type of ink jetting operation will be referred to as "non-recording ink jetting operation".

As described above, if an ink jet recording apparatus is left unused while being kept in the condition in which it is not ready for recording, or in the like condition, the body of ink in the ink jetting opening portion of an ink jetting nozzle, and the body of ink in the liquid passage leading thereto, sometimes lose their liquid ingredients, increasing thereby in viscosity and/or solidify. In such a situation, the operation in which ink is recirculated through the recording head by pressure application to restore the performance of the recording head. If the length of time an ink jet recording apparatus has been left unused is relatively short, and therefore, the amount of the increase in ink viscosity is slight, the abovementioned "non-recording ink jetting operation", that is, the ink jetting operation which is not intended for recording, is carried out to restore the recording head into the condition in which it can normally record.

Figure 3:
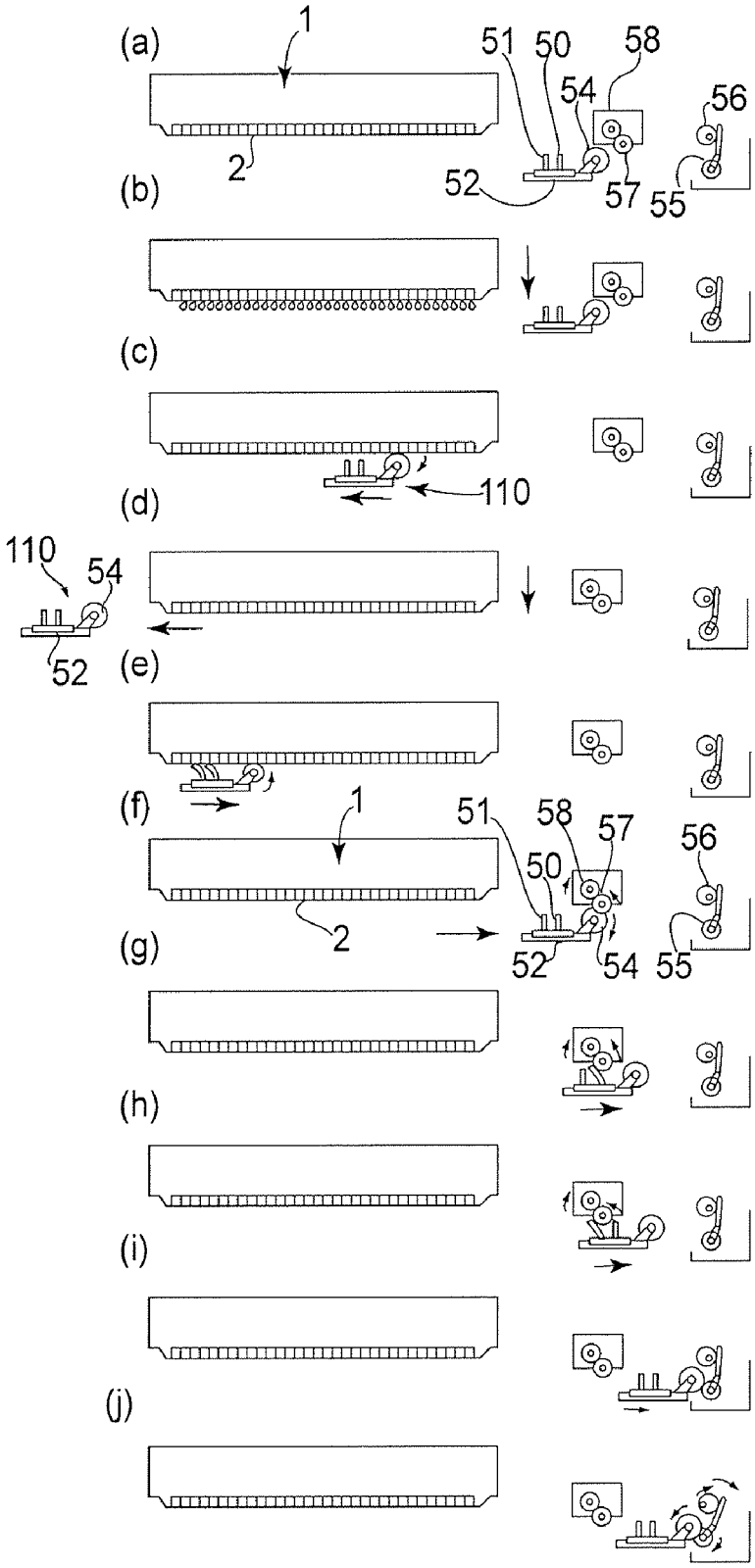
FIG. 3 is a schematic drawing showing the recovery sequence for restoring the performance of the recording head of the ink jet recording apparatus in the first embodiment.
Figure 4:
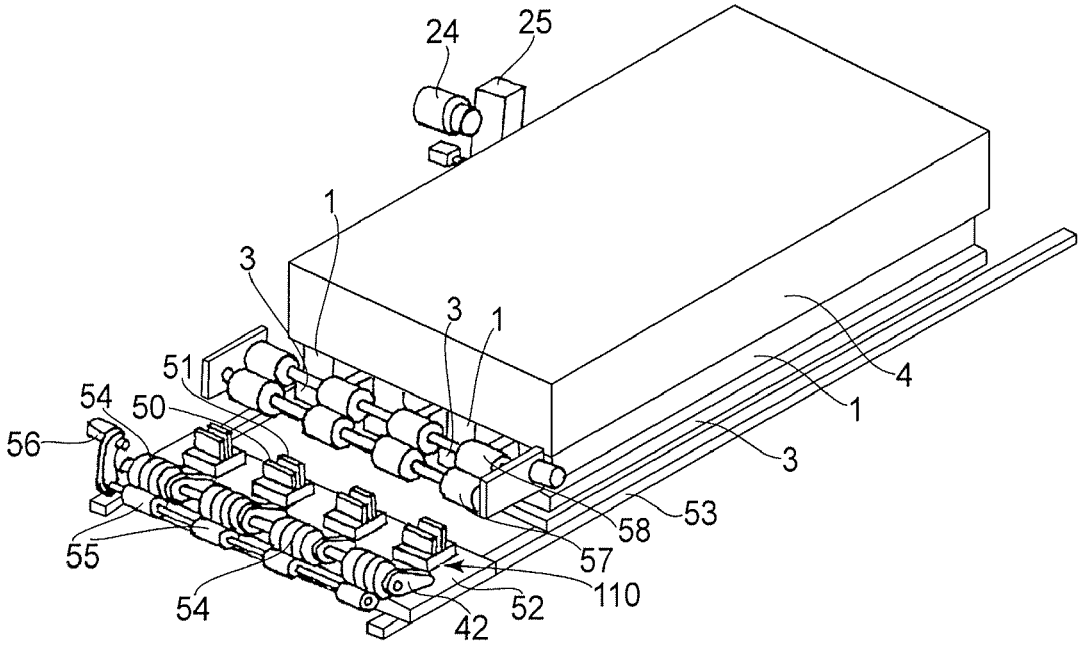
FIG. 4 is a perspective view of the recording head of the ink jet recording apparatus, in the first embodiment, which is capped.
Figure 5:
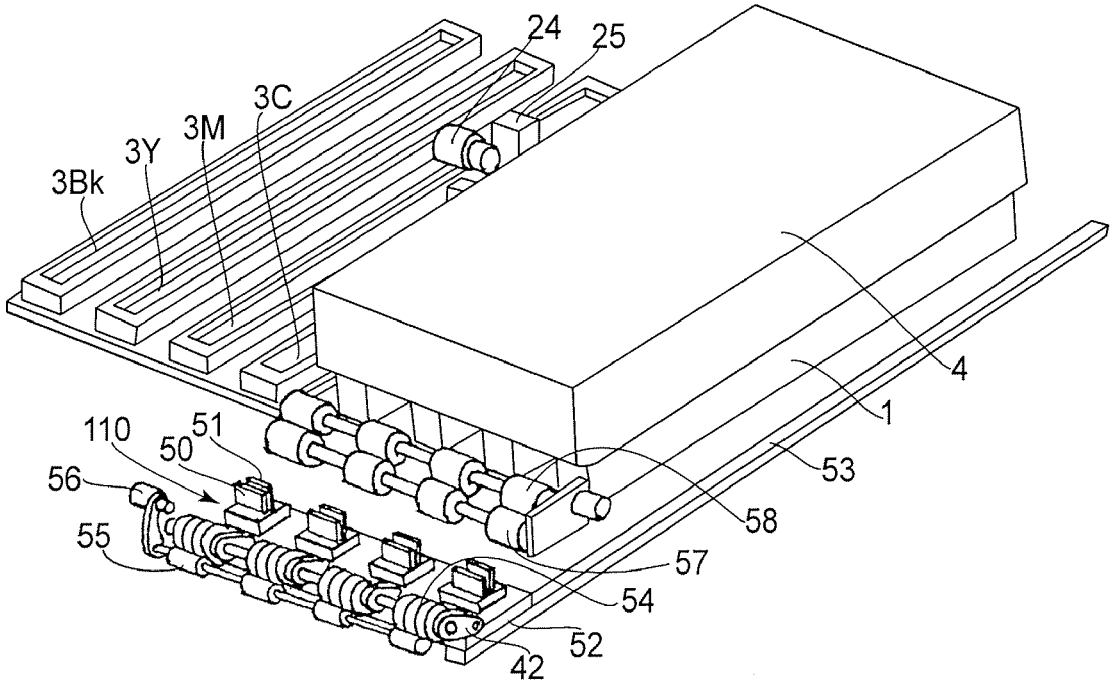
FIG. 5 is a perspective view of the recording head of the ink jet recording apparatus, in the first embodiment, which has been separated from the capping portion by being horizontally moved after being raised from the position shown in FIG. 4.
Figure 6:
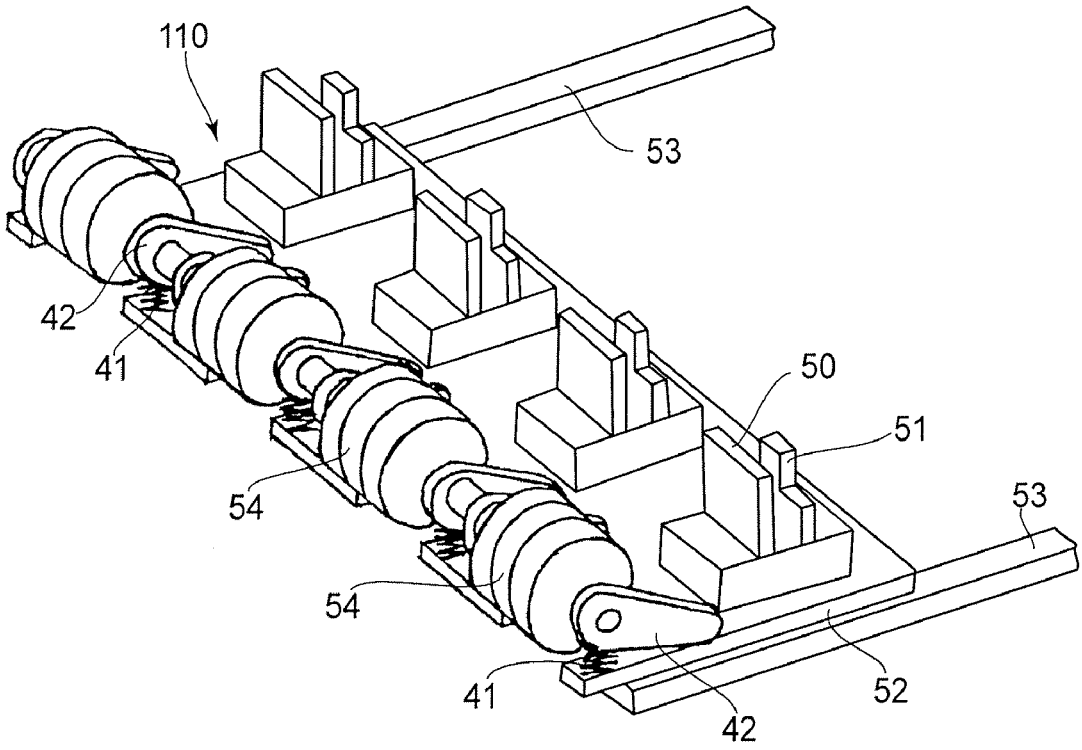
FIG. 6 is a perspective view of the cleaning apparatus for cleaning the ink jetting surface of the recording head of the ink jet recording apparatus in the first embodiment.
Figure 7:
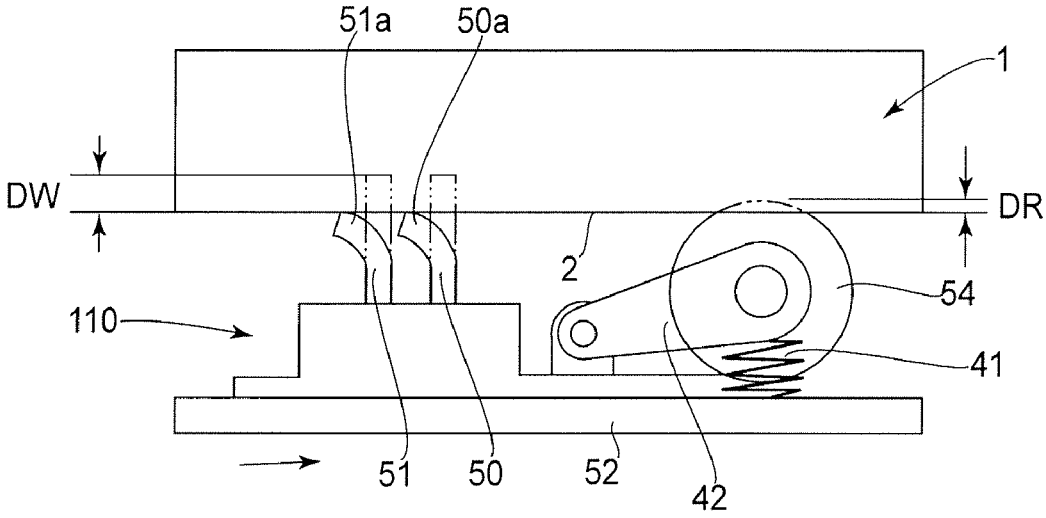
FIG. 7 is a side view of the wiping member and absorbent member, in the first embodiment, showing the state of contact between them and the ink jetting surface of the recording head during the cleaning operation.
Figure 8:
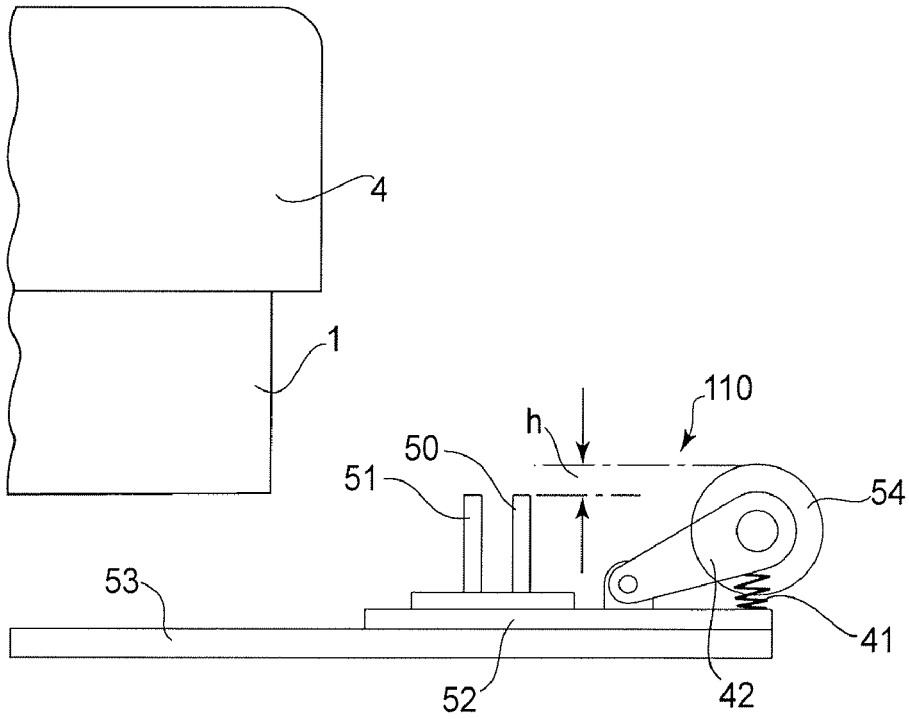
FIG. 8 is a side view of the cleaning apparatus of the ink jet recording apparatus in the first embodiment.

FIG. 3 is a schematic drawing showing the operational sequence to be carried out to restore the performance of the recording head of the ink jet recording apparatus in the first embodiment. FIG. 4 is a perspective view of the recording head, in the first embodiment, which is in the capped state. FIG. 5 is a perspective view of the same recording head as the one shown in FIG. 4, which has been separated from the capping portion by being horizontally moved after being raised from the position shown in FIG. 4. FIG. 6 is a perspective view of the cleaning apparatus for cleaning the ink jetting surface of the recording head of the ink jet recording apparatus in the first embodiment. FIG. 7 is a side view of the wiping member and absorbent member, in the first embodiment, showing the state of contact between them and the ink jetting surface of the recording head during the cleaning operation. FIG. 8 is a side view of the cleaning apparatus of the ink jet recording apparatus in the first embodiment.

Referring to FIGS. 4 and 5, the ink jet recording apparatus in the first embodiment has four recording heads 1C, 1M, 1Y, and 1Bk, which are different in the color of the ink therein, and which are mounted on the common head holder 4. The recording heads 1C, 1M, 1Y, and 1Bk are recording heads which use cyan, magenta, yellow, and black inks, respectively. The recording heads on the head holder 4 are precisely positioned relative to the head holder 4 so that their relationship in terms of parallelism, interval, etc., is highly precisely maintained. Incidentally, when it is necessary to refer to a specific component, among the components, such as recording heads or caps, the number of which corresponds to the number of inks different in color, which is linked to a specific ink color, one of the referential suffixes C, M, Y, and Bk which represent the color of the inks, one for one, is assigned to the primary referential symbol which designates a specific group of components which are identical in structure. However, when it is necessary to refer to the entirety of the multiple components, such as the multiple recording heads or multiple caps, or to refer to one of the multiple components, which is not linked to a specific color, it will be referred to only by the primary referential symbol.

A command for starting the cleaning operation is issued from the control portion, with the ink jetting surface capped as shown in FIG. 4, after the completion of an operation for recording an image on recording medium, the completion of the performance restoration operation in which ink is forcefully jetted through the ink jetting openings, or after the completion of the like operations. As the command is issued, the relationship between the recording head and the capping portion changes from the one shown in FIG. 4 to the one shown in FIG. 5. That is, as the command for starting the cleaning operation is issued, the relationship between the recording head changes from the one in which the ink jetting surface of the recording head is capped with the capping portion (made up of four caps 3), to the one in which the capping portion (made up of four caps 3) are not in contact with the recording head 1. More specifically, the head holder 4 is moved upward by a motor 24 along the vertical guide 25, and then, the capping portion (made up of four caps 3) is horizontally moved leftward (in FIG. 5) to move the cap portion away from the recording head 1. Then, the actual cleaning operation, which will be described later with reference to FIG. 3, is carried out while the recording head 1 and capping portion are kept in the state shown in FIG. 5.

At this point in time, referring to FIGS. 4-6, a cleaning apparatus 110 for cleaning the ink jetting surface of the recording head will be described. In FIGS. 4-6, designated by a referential symbol 54 is an absorbent member for removing, from the ink jetting surface 2, the ink, etc., which have adhered to the ink jetting surface 2, by absorbing the ink, etc. The absorbent member 54 is in the form of a cylindrical roller, and is formed of an absorbent substance. As for the material for the absorbent member 54, a substance, such as a porous substance formed of hydrophilic polyurethane or a porous substance formed of hydrophilic polyethylene, which is excellent in liquid absorbency, is used. Designated by referential symbols 50 and 51 are wiping members for wiping (scraping) away the ink, etc., which have adhered to the ink jetting surface 2. As the material for these wiping members, an elastic substance, such as urethane resin, is used. The wiping members are in the form of a piece of thin plate; they are in the form of a blade.

The absorbent member 54 and wiping members 50 and 51 are mounted on a cleaner base 52, which is movable by an unshown driving force source, for example, a performance restoration motor, which is the driving force source of the performance restoration unit, along a rail 53 disposed in the direction parallel to the direction in which the ink jetting openings of the recording head 1 are arranged. The absorbent member 54 is rotatably supported on the cleaner base 52. The absorbent member 54 cleans the ink jetting surface 2 of the recording apparatus by contacting the ink jetting surface 2 while being rotated by the friction between the absorbent member 54 and ink jetting surface 2. The wiping members are paired for the following reason. That is, in order to improve the wiping member in wiping performance, the cleaning apparatus is structured so that when wiping the ink jetting surface of a recording head, in particular, a full-line head, which is very long, the wiping member 50, or the leading wiping member, wipes the entirety of the ink jetting surface, whereas the wiping member 51, or the trailing wiping member, wipes only the area of the ink jetting surface, across which the ink jetting openings are arranged.

Figure 9:
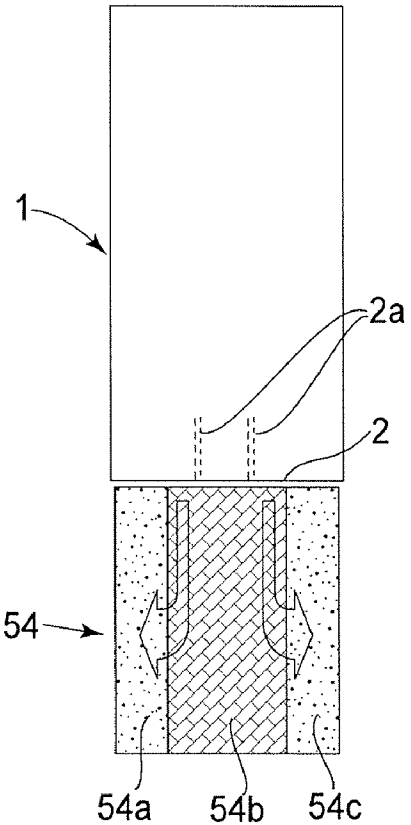
FIG. 9 is a vertical sectional view of the absorbent member, which is cleaning the ink jetting surface of the recording head, and the recording head, the ink jetting surface of which is being cleaned by the absorbent member, at a plane perpendicular to the direction in which the absorbent member and recording head are moved when the ink jetting surface is cleaned.

FIG. 9 is a vertical sectional view of the absorbent member 54 and recording head 1, in the first embodiment, at a plane perpendicular to the direction in which the absorbent member 54 is moved when cleaning the ink jetting surface. Referring to FIG. 9, the absorbent member 54 is made up of multiple (three in this embodiment) absorbent sections 54*a*, 54*b*, and 54*c*, which are in the form of a roller (or cylindrical or disk-like). These absorbent sections are joined (inclusive of being solidly joined) in the direction roughly perpendicular to the cleaning direction (direction in which ink jetting openings are arranged). On the other hand, the ink jetting surface 2 of the recording head 1 is provided with the multiple ink jetting openings 2*a*, which are arranged in two columns, which are perpendicular to the surface of the drawing. The center absorbent section 54*b* is positioned so that it absorbs the ink having adhered to the area of the ink jetting surface 2, which is the adjacencies of the two columns of ink jetting openings 2*a*, by coming in contact with the area. The lateral small absorbent sections 54*a* and 54*c* are positioned so that they come into contact with the areas of the ink jetting surface 2 other than the abovementioned area, or do not come into contact with the ink jetting surface 2. Incidentally, the absorbent member 54 shown in FIG. 9 is also usable with a recording head, the ink jetting openings of which are arranged in a single column, or three or more columns, as effectively as it is usable with the recording head 1 in this embodiment.

As the material for each of the absorbent sections 54*a*, 54*b*, and 54*c* of the absorbent member 54, which is in the form of a roller, a substance, such as a porous substance formed of hydrophilic polyurethane or a porous substance formed of hydrophilic polyethylene resin, which excels in liquid absorbency, is preferable. Thus, in this embodiment, the center absorbent section 54*b* of the absorbent member 54, which is in the form of a roller and comes into contact with the ink jetting openings and the areas adjacent thereto, is formed of a porous substance, which is greater in average pore diameter than the substance of which the lateral absorbent sections 54*a* and 54*c* are formed.

Figure 10:
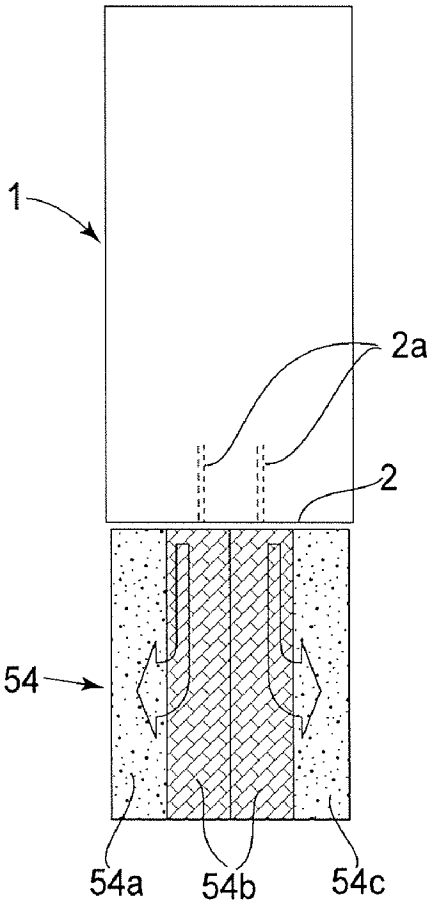
FIG. 10 is a vertical sectional view of another absorbent member, in the first embodiment, which is different in structure from the preceding one.

FIG. 10 is a vertical sectional view of another absorbent member 54 in the first embodiment, which is different in structure from the absorbent member 54 shown in FIG. 9. The absorbent member 54 shown in FIG. 10 is made up of four absorbent sections 54*a*, 54*b*, 54*c*, and 54*d*, which are in the form of a roller. The four absorbent sections 54*a*, 54*b*, 54*c*, and 54*d* are joined in the direction which is roughly perpendicular to the direction in which the absorbent member 54 is moved to clean the ink jetting surface 2. On the other hand, the center area of the ink jetting surface 2 of the recording head 1 is provided with the multiple ink jetting openings 2*a*, which are arranged in two columns, which are perpendicular to the surface of FIG. 10. The absorbent sections 54*b* that is, the center absorbent sections of the absorbent member 54, which are greater in average pore diameter than the lateral absorbent sections 54*a* and 54*c*, are positioned so that they absorb the ink having adhered to the areas of the ink jetting surface 2, which are adjacent to the two columns of ink jetting openings 2*a*, by coming in contact with the areas. The lateral absorbent sections 54*a* and 54*c*, which are smaller in average pore diameter than the absorbent sections 54*b* and 54*b*, are positioned so that they come into contact with the areas of the ink jetting surface 2 other than the abovementioned areas, or do not come into contact with the ink jetting surface 2. Incidentally, the absorbent member 54 shown in FIG. 10 is also usable with a recording head, the ink jetting openings of which are arranged in a single column, or three or more columns, as effectively as it is usable with the recording head 1 in this embodiment.

Figure 11:
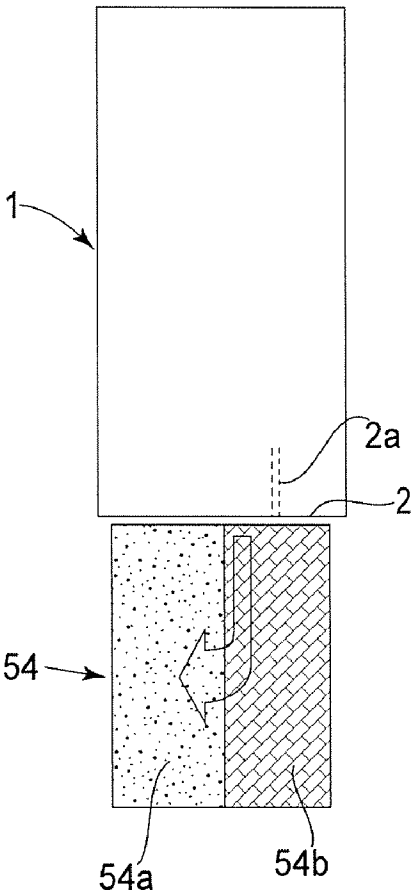
FIG. 11 is a vertical sectional view of yet another absorbent member, in the first embodiment, which is different in structure from the preceding ones.

FIG. 11 is a vertical sectional view of yet another absorbent member 54 in the first embodiment, which is different in structure from the preceding ones. The absorbent member 54 shown in FIG. 11 is made up of two absorbent sections 54*a* and 54*b* which are in the form of a roller. The two absorbent sections 54*a* and 54*b* are joined in the direction roughly perpendicular to the cleaning direction. On the other hand, the ink jetting surface of the recording head is provided with a single column of ink jetting openings 2*a*, which is on the right-hand side (in drawing) and is perpendicular to the surface of the drawing. The right-hand absorbent section 54*b*, which is greater in the average pore diameter, is positioned so that it comes into contact with the single column of ink jetting openings 2*a* and its adjacencies to absorb the ink having adhered thereto. The left-hand absorbent member 54*a*, which is on the left-hand side (in drawing) and is smaller in average pore diameter, is positioned so that it comes with the areas of the ink jetting surface other than the abovementioned area of the ink jetting surface, with which the absorbent member 54*a* comes into contact, or do not come into contact with the ink jetting surface. Incidentally, the absorbent member shown in FIG. 11 is also usable with a recording head, the ink jetting surface of which are arranged in a single column, or three or more columns, as effectively as it is usable with the recording head 1 in this embodiment.

That is, in this embodiment, the absorbent roller 54 as an absorbent member is made up of multiple absorbent sections, which are different in average pore diameter. The multiple absorbent sections are joined so that their axial lines coincide. The cleaning apparatus is structured so that the absorbent section which is larger in average pore diameter is placed in contact with the ink jetting openings of the ink jetting surface 2, and their adjacencies, to remove the ink by absorbing the ink. The absorbent sections 54*a* and 54*c*, or the lateral absorbent sections, and the absorbent section 54*b*, or the center absorbent section, may be formed of the same material, as long as the lateral sections can be rendered different in pore diameter from the center section. According to the studies conducted by the inventors of the present invention, it is desired that the porous substance used as the material for the absorbent sections 54*a* and 54*c* is roughly 5-10 μm in average pore diameter, whereas the porous substance used as the material for the absorbent section 54*b* which is to be placed in contact with the areas adjacent to the ink jetting openings is roughly 50-100 μm in average pore diameter. Incidentally, the number of the absorbent sections to be joined in a single line to make up the absorbent member 54, and the average pore diameter of each absorbent section, may be adjusted as necessary.

With the employment of the above described structural arrangement, as the absorbent member 54 is moved in contact with the ink jetting surface of the recording head, the ink on the ink jetting surface is absorbed first by the absorbent section 54*b* of the absorbent member 54, which is larger in average pore diameter than the lateral absorbent sections 54*a* and 54*c*. The ink absorbed by the absorbent section 54*b* is absorbed by (transferred into) the absorbent sections 54*a* and 54*c* of the absorbent member 54, which are in contact with the absorbent section 54*b*, and are smaller in average pore diameter, being therefore stronger in capillary force, than the absorbent section 54*b*. As a result, the absorbent section 54*b*, which came into contact with the adjacencies of the ink jetting openings and absorbed the ink thereon, is reduced in the amount of the ink therein. Thus, the absorbent section 54*b* is restored in ink absorbency. In other words, it is possible to prevent the reduction in the ink absorption performance of the absorbent section 54*b* attributable to the increase in the amount of the ink in the absorbent section 54*b*. Therefore, the ink absorption performance of the absorbent member is kept at a satisfactory level for efficiently removing the ink by absorbing it.

Incidentally, it is needless to say that the absorbent member needs to be adjusted in average pore diameter according to the materials for the absorbent member, and the viscosity, surface tension, dye, pigment, etc., of the ink, which affect ink properties. One of the essences of the present invention is that the absorbent section of the absorbent member, which comes into contact with the ink jetting openings 2*a* and their adjacencies, is rendered greater in average pore diameter than the absorbent sections of the absorbent member, which are in contact with the absorbent section of the absorbent member, which comes into contact with the ink jetting openings 2*a* and their adjacencies. Another essence of the present invention is to absorb the ink into one of the absorbent sections of an absorbent member, and then, transfer the ink in this absorbent section, into the absorbent sections adjacent to this absorbent section, by utilizing the capillary force of the adjacent absorbent sections.

Referring to FIGS. 4-6, the absorbent roller 54, and wipers 50 and 51, are mounted on the cleaner base 52. As the cleaner base 52 is moved along the rail 53 by an unshown driving force source, the cleaning apparatus 110 having the absorbent roller and wipers moves in the direction parallel to the direction in which the ink jetting openings of the recording head are arranged. While the cleaning apparatus 110 is moved in the abovementioned direction, the absorbent member 54 and wipers 50 and 51 move in contact with the ink jetting surface, while being kept pressed upon the ink jetting surface of the recording head, by the preset amount of contact pressure, and therefore, apparently intruding into the ink jetting surface by preset amounts.

Referring to FIGS. 6-8, the absorbent rollers 54 are rotatably supported by arms 42, which are attached to the cleaner base 52 so that the arms 42 are allowed to pivot about the pins with which the arms 42 are attached to the cleaner base 52. The absorbent rollers 54 are kept at a preset height from the cleaner base 52, by springs 41. The positional relationship among the absorbent member 54, wiping members 50 and 51, and ink jetting surface 2 while the ink jetting surface 2 is cleaned is as shown in FIG. 7. While the cleaning apparatus is in the position in which the cleaning apparatus does not face the ink jetting surface, the positional relationship, in terms of vertical direction, between the absorbent member and wiping member on the cleaner base is as shown in FIG. 8. In this embodiment, the recording apparatus is structured so that while the ink jetting surface is cleaned with the absorbent member and wiping member, the absorbent member is moved ahead of the wiping member, as shown in FIG. 3(E).

Referring to FIG. 8, the absorbing member 54 and wiping members 50 and 51 are disposed on the cleaner base 52 so that the position of the top of the absorbent member 54 remains higher by a value of h than the highest point of the wiping member 50 or 51. the value of h is in the range in which the absorbent member 54 is elastically compressible. Referring to FIG. 7, when the ink jetting surface is cleaned by both the absorbent member 54 and wiping members 50 and 51, the wiping members 50 and 51 are kept in contact with the ink jetting surface, with the edge portions 50*a* and 51*a* of the wiping members 50 and 51, respectively, remaining elastically bent, so that the amount of the apparent intrusion of the wiping members into the ink jetting surface is a preset value of DW. Incidentally, as it will become evident from the preceding, as well as following, descriptions of this embodiment, the recording apparatus in this embodiment is provided with four cleaning apparatuses 110, shown in FIGS. 7 and 8, one for each of the four ink jet recordings heads different in color. In practical terms, the four cleaning apparatuses 110 are the same in structure and operation. Thus, the structure and operation of only one of the four cleaning apparatuses will be described with reference to FIGS. 3, and 7-11, which show one of the four cleaning apparatuses 110.

First, referring to FIG. 3, an example of the performance restoration sequence which is carried out with the use of the cleaning apparatus 110 in the first embodiment described above will be described. Disposed on the right-hand side (in FIG. 3) of the ink jetting surface 2 of the full-line recording head 1 are a wiping member cleaning means for cleaning wipers 50 and 51, and a squeezing means for squeezing ink out of the absorbent member 54. The wiping member cleaning member is made up of a pair of wiper cleaners 57 and 58. The squeezing means is made up of a squeezer roller 55 and a cam 56. As the absorbent member 54 is moved in contact with the ink jetting surface 2 to clean the ink jetting surface 2, it is rotated by the friction between the absorbent member 54 and ink jetting surface 2, being thereby enabled to absorb the ink, or the like, having adhered to the ink jetting surface 2, while wiping the ink jetting surface 2 without rubbing it.

Referring to FIG. 3, FIG. 3(A) shows the cleaning apparatus which is on standby during the performance restoration sequence. When the cleaning apparatus is in the state shown in FIG. 3(A), or on standby, the cap 3 is kept away from the recording head 1, with the cleaner base 52, which are holding the absorbent member 54 and wiping members 50 and 51, positioned on the right-hand side (in drawing). It is when the cleaning apparatus is in this state that the ink discharging operation in which ink is discharged from all of the ink jetting openings of the recording head 1 as shown in FIG. 3(B) is carried out. In this ink discharging operation, ink is circulated through the common liquid chamber 152 with the pressure generated by driving the pump 159 in the performance restoration system shown in FIG. 2. As ink is circulated, the ink is discharged from all the ink jetting openings. As a result, the ink in the ink jetting nozzles of the recording head is replaced with a fresh supply of ink. However, if the amount of decline in the ink jetting performance of the recording head is relatively small, the so-called non-recording ink jetting operation, that is, the ink jetting operation in which ink is jetted out of all the ink jetting openings, for a non-recording purpose, may be carried out instead of the above described ink discharging operation, depicted in FIG. 3(B) in which ink is circulated by the pressured generated pump 159.

As ink is discharged as described above, the ink jetting surface 2 is covered with the ink mist or the like; after the ink discharge, the ink jetting surface 2 is covered with the ink having adhered thereto. After the ink discharge, the recording head 1 is lowered by the motor 24 (FIG. 5) in the direction indicated by an arrow mark in FIG. 3(B) to position the recording head 1 so that the ink jetting surface 2 can be cleaned by the absorbent member 54. Then, the cleaning apparatus 110 is moved leftward (in drawing) to cause the absorbent member 54 to remove (wipe away) the ink having adhered to the ink jetting surface 2 by absorbing the ink, as shown in FIG. 3(C). When the cleaning apparatus 110 is in the state shown in FIG. 3(C), the wiping members 50 and 51 are not in contact with the ink jetting surface 2; in other words, only the absorbent member 54 is in contact with the ink jetting surface 2 to clean the ink jetting surface 2. As the absorbent member 54 is moved, it is rotated by the friction between the ink jetting surface 2 and absorbent member 54 while cleaning the ink jetting surface 2. As the ink jetting surface 2 is cleaned as shown in FIG. 3(C), the cleaner base 52 moves to the left-hand end of its moving range, shown in FIG. 3(D), and stops there.

While the recording head is in the position shown in FIG. 3(D), it is lowered by a preset distance (in addition to preset distance by which it was lowered at right-hand end of its moving range). As a result, both the absorbent member 54 and wiping members 50 and 51 are placed in contact with the ink jetting surface 2 in a manner to apparently intrude into the ink jetting surface 2 by a preset distance as shown in FIG. 7. Then, the cleaning apparatus 110 is moved rightward (in drawing) to clean the ink jetting surface 2 with both the absorbent member 54 and wiping members 50 and 51, as shown in FIG. 3(E). During this period, the amount of the contact pressure applied to the ink jetting surface 2 by the absorbent member 54 is kept at a proper level by the resiliency of the springs 41 shown in FIGS. 6 and 7. In other words, in this embodiment, as the cleaning apparatus is moved from the right-hand end of its moving range to the left-hand end, and then, is returned to the right-hand end, the ink jetting surface 2 is cleaned by the synergistic combination of the wiping (cleaning) functions of the absorbent member 54 and wiping members 50 and 51. Therefore, even the ink jetting surface 2 of a full-line recording head of a substantial length can be efficiently cleaned.

FIG. 3(F) shows the process for cleaning the wiper cleaners 57 and 58 which are for cleaning the wiping members 50 and 51. That is, at the end of the ink jetting surface cleaning process shown in FIG. 3(E), the cleaner base 52 is stopped in the position shown in Figure (F) to place the absorbent member 54 in contact with the wiper cleaner 57. Then, the wiper cleaner 57 is rotationally driven to clean the wiper cleaners 57 and 58. The wiper cleaners 57 and 58 are in the form of a roller, and are formed of the same material as that for the absorbent member 54, for example, porous hydrophilic resin, porous hydrophilic polyethylene, or the like, which is highly ink absorbent.

FIGS. 3(G) and 3(H) show the wiper cleaning process for cleaning the wiping members 50 and 51. After the completion of the cleaning process shown in FIG. 3(F), the cleaner base 52 is moved rightward (in drawing) by a preset distance to the position shown in FIG. 3(G), in which the cleaner base 52 is stopped, with the wiping member 50 is placed in contact with the wiper cleaner 57. Then, the cleaner base 52 is moved further rightward by a preset distance to the position shown in FIG. 3(H), in which the wiping member 51 is placed in contact with the wiper cleaner 57. In both positions, the corresponding wiping members 50 or 51 is cleaned by rotationally driving the wiper cleaner 57.

After the completion of the wiping member cleaning processes shown in FIGS. 3(G) and 3(H), the cleaner base 52 is moved rightward (in drawing) by a preset distance to the position shown in FIGS. 3(I) and 3(J), in which the process for restoring the absorbent member 54 in absorbency is carried out as shown in FIGS. 3(I) and 3(J). This restoration process is for squeezing ink out of the absorbent member 54. That is, the cleaner base 52 is stopped in the position shown in FIG. 3(I) so that the absorbent member 54 is placed close to, or in contact with, the squeezer roller 55. Then, the cam 56 is rotationally driven by a preset angle to press the squeezer roller 55 upon the absorbent member 54 so that a preset amount of contact pressure is generated between the squeezer roller 55 and absorbent member 54. Then, the ink having been absorbed in the absorbent member 54 is squeezed out by rotationally driving the squeezer roller 55 as shown in FIG. 3(J). As a result, the absorbent member 54 is restored in ink absorbency. The cleaning apparatus position shown in FIG. 3(J), in which the ink in the absorbent member 54 is squeezed out, is the home position of the cleaning apparatus 110 (cleaning base 52).

After the completion of the process (for squeezing out ink), shown in FIG. 3(J), which is for restoring the absorbent member 54 in absorbency, which is shown in FIG. 3(J), the head holder 4 (recording head 1) is raised along the vertical guide 25, by driving the motor 24, to the standby position shown in FIG. 3(A). Thereafter, the cape 3 is horizontally moved to make the cap 3 face the ink jetting surface 2 of the recording head 1. Then, the recording head 1 is lowered to place the ink jetting surface 2 airtightly in contact with the cap 3, as shown in FIG. 4, completing thereby the performance restoration sequence. In some cases, the recording head 1 may be kept in the position shown in FIG. 3(A); it may be kept on standby for the following performance restoration operation.

Incidentally, in this embodiment, the recording apparatus was structured so that the performance restoration operation was carried out all at once for all the recording heads. However, the recording apparatus may be structured so that the multiple cleaning apparatuses 110, with which the multiple recording heads are provided one for one, can be individually or selectively driven to individually or selectively clean the recording heads different in color. Further, the recording apparatus was structured so that the absorbent member 54 was rotated by the friction between the absorbent member 54 and recording head 1. However, the recording apparatus may be structured so that the absorbent member 54 is rotationally driven by its own driving force source. Further, the recording apparatus was structured so that the tip portions of the wiping members are cleaned while the cleaner base 52 was kept stationary in the positions shown in FIGS. 3(G) and 3(H). However, the recording apparatus may be structured so that the tip portions are cleaned without stopping the cleaner base, for example, while moving the cleaner base at a preset speed. Moreover, each of the processes described with reference to FIGS. 3(A)-3(J) may be switched in position, eliminated, or repeated, as necessary.

Figure 12:
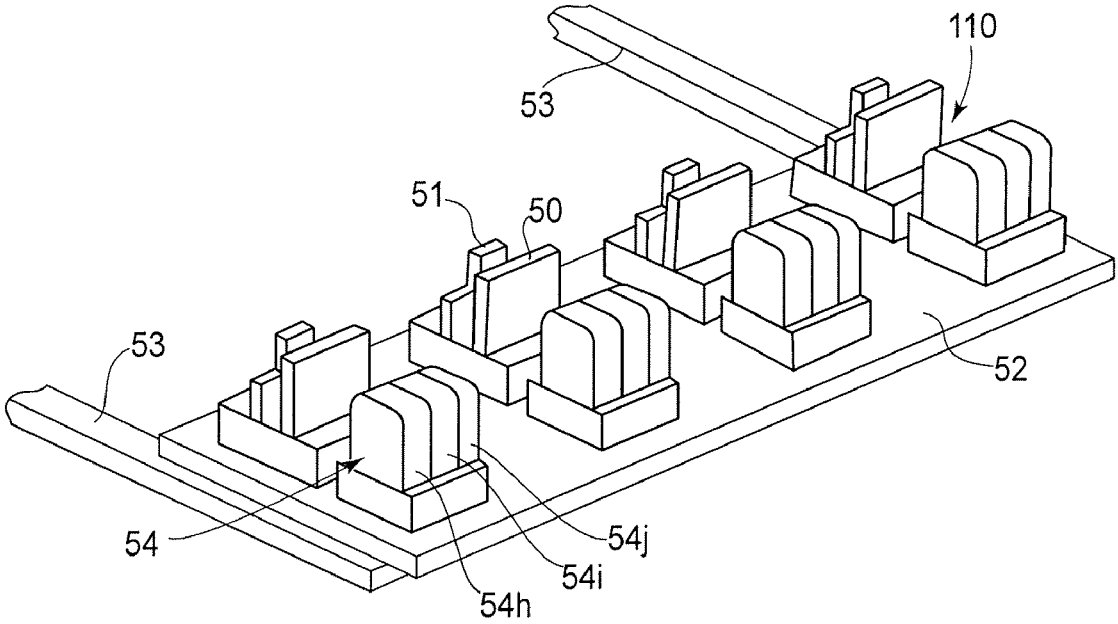
FIG. 12 is a perspective view of the cleaning apparatus in the second embodiment of the present invention.

FIG. 12 is a perspective view of the cleaning apparatus 110 in the second embodiment of the present invention. Referring to FIG. 12, in this embodiment, the absorbent member 54, which is mounted on the cleaner base 52, is made of three absorbent sections 54*h*, 54*i*, and 54*j* which are in the form of a block. The three absorbent sections 54*h*, 54*i*, and 54*j* are joined in a single line so that the combination of the three absorbent sections is also in the form of a block. In this embodiment, the recording apparatus is structured so that the absorbent member, in the formed of a block, which is solidly attached to the cleaner base 52, is employed in place of the rotatable absorbent member (absorbent roller) employed in the first embodiment. In other words, the recording apparatus in this embodiment is different from that in the first embodiment only in that the absorbent member 54 is in the form of a block; otherwise, the two recording apparatuses are practically the same in structure. Therefore, the components, portions, etc., of the recording apparatus in this embodiment, are designated by the same referential symbols as those given to the corresponding components, portions, etc., in the first embodiment, and will not be described in detail.

Referring to FIG. 12, the absorbent member 54 is made up of multiple (three in this embodiment: sections 54*h*, 54*i*, and 54*j*) absorbent sections which are in the form of a block. The multiple absorbent sections 54*h*, 54*i*, and 54*j* are joined (inclusive of being solidly joined) in a single line in the direction which is roughly perpendicular to the cleaning direction (which is parallel to the direction in which ink jetting openings are arranged). This absorbent member 54 is used in the state shown in FIG. 9. That is, the center absorbent section 54*i* of the absorbent member 54 is positioned so that it absorbs the ink having adhered to the ink jetting openings 2*a* arranged in a single or two or more columns, and the adjacencies thereof, by coming in contact therewith, whereas the two lateral absorbent sections 54*h* and 54*j* of the absorbent member 54 are disposed in contact with the other areas of the ink jetting surface 2, or not to contact the ink jetting surface 2.

As the material for each of the absorbent sections 54*h*, 54*i*, and 54*j* of the absorbent member 54, porous hydrophilic resin, porous hydrophilic polyethylene, or the like, for example, which is highly ink absorbent, is suitable. Thus, the absorbent member 54 in this embodiment is made up of one of the abovementioned substances, and the center absorbent section 54*i* which comes into contact with the ink jetting openings of the ink jetting surface and the adjacencies thereof to absorb ink is rendered larger in average pore diameter than the lateral absorbent sections 54*h* and 54*j*.

Further, the absorbent member 54 in this embodiment may be made up of four absorbent sections, which is joined in a single line in the direction roughly perpendicular to the direction in which ink jetting openings are arranged in FIG. 10, or may be made up of two absorbent sections joined in the same direction as the direction in which the abovementioned four absorbent sections are aligned; it may be variously structured. These absorbent sections of the absorbent member 54 in this embodiment are joined in the same manner as those in the first embodiment so that the center absorbent section 54*i* of the absorbent member 54 comes into contact with the single, or two or more, columns of ink jetting openings, and the adjacencies thereof, and absorb the ink having adhered thereto, whereas the two lateral absorbent sections 54*h* and 54*j* of the absorbent member 54 are placed in contact with the other areas of the ink jetting surface 2, or not to contact the ink jetting surface 2.

Figure 13:
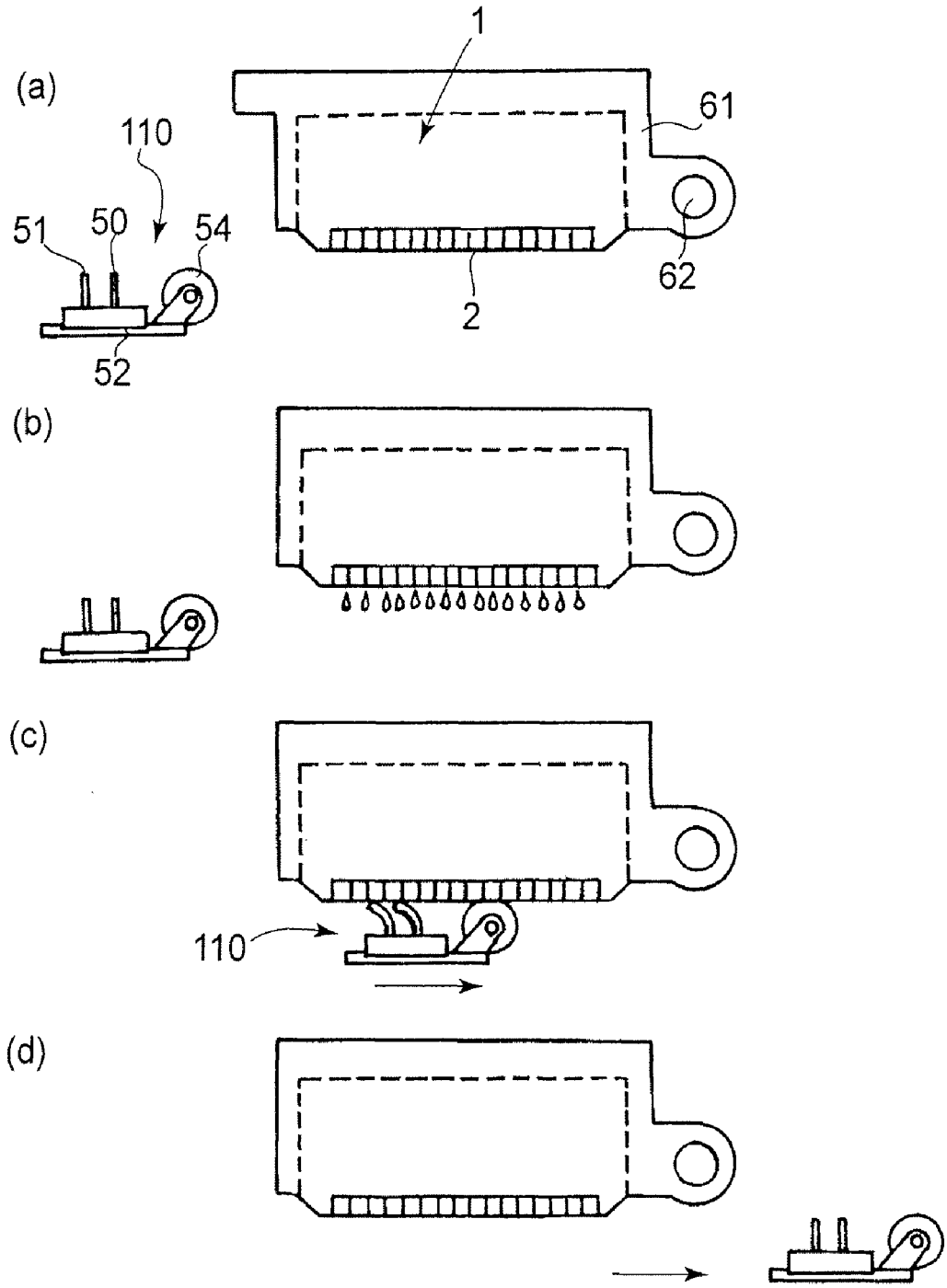
FIG. 13 is a schematic drawing showing the operational sequence for restoring in performance the recording head in the third embodiment of the present invention.

FIG. 13 is a schematic drawing showing the operation sequence for restoring the performance of the recording head in the third embodiment of the present invention. In this embodiment, the cleaning apparatuses in the above described first and second preferred embodiments is employed by an ink jet recording apparatus of the serial type. Referring to FIG. 13, the recording head 1 is mounted on a carriage 61, which is reciprocally movable along a guide shaft 62 and a guide rail (unshown), with which the main assembly of the recording apparatus is provided, in the primary direction, which is parallel to the width direction of the recording medium, in a manner of scanning the recording medium. The ink jetting surface 2 of the recording head 1 is provided with multiple ink jetting openings 2*a*, which are arranged in the direction roughly perpendicular to the moving direction of the carriage 61. In practical terms, the cleaning apparatus 110 in this embodiment is the same in structure, operation, and effect, as those in the preceding preferred embodiments, unless specifically noted.

Referring to FIG. 13, the cleaning apparatus 110 made up of the absorbent member 54 and wiping members 50 and 51 is structured so that it can clean the ink jetting surface 2 in the direction parallel to the direction in which the ink jetting openings are arranged. Thus, this absorbent member 54 is also made up of multiple porous absorbent sections, which are joined in a line in the direction roughly perpendicular to the cleaning direction (parallel to direction in which ink jetting openings are arranged), as in the preceding preferred embodiments described above. Further, some of the multiple absorbent sections are rendered larger in average pore diameter than the others, as those in the preceding embodiments. Moreover, the recording apparatus in this embodiment is structured so that when cleaning the ink jetting surface 2, the absorbent sections of the absorbent member 54, which are larger in average pore diameter, are placed in contact with the ink jetting openings and their adjacencies of the ink jetting surface, to absorb ink.

Next, referring to FIG. 13, an example of the performance restoration operation sequence in this embodiment will be described. In FIG. 13, FIG. 3(A) shows the cleaning apparatus which is on standby during the performance restoration sequence. When the cleaning apparatus is in the state shown in FIG. 3(A), or on standby, the cleaner base 52 is on the left-hand side (in drawing) of the recording head. It is when the cleaning apparatus is in this state that an ink discharging operation similar to the ink discharging operation 1 shown in FIG. 3(B) is carried out. This ink discharging operation is an operation in which ink is discharged from all the ink jetting openings with the use of the same method as the one shown in FIG. 2. Also in this case, the pressurized ink circulating operation may be replaced with a non-recording ink jetting operation, that is, an operation in which ink is jetted from all the ink jetting openings for a non-recording purpose. As ink is discharged as described above, the ink jetting surface 2 is covered with the ink having adhered thereto. Incidentally, the ink mist generated during a recording operation sometimes adheres to the ink jetting surface 2. After the ink discharge, the recording head 1 is lowered to position the recording head 1 so that the ink jetting surface 2 can be cleaned.

Then, the cleaning apparatus 110 is moved rightward (in drawing) to cause the absorbent member 54 and wiping members 50 and 51 to clean the ink jetting surface 2. The absorbent member shown in the drawings is in the form of a roller. However, the absorbent member in this embodiment may also be in the form of a block like the one in the second embodiment. After the cleaning operation, the cleaning apparatus 110 is stopped on the right-hand side (in drawing) of the recording head, at the location shown in FIG. 3(D). Then, when the cleaning apparatus 110 is at this location, the recording head is raised. Then, the recording head is moved into the position in which its ink jetting surface directly faces the cap. Then, the recording head is lowered to cap the ink jetting surface of the recording head, ending thereby the recovery sequence. Incidentally, the cleaning apparatus 110 and recording head may be put on standby in the positions shown in FIG. 13(D), for the next cleaning of the ink jetting surface, as it is on standby in the position shown in FIG. 13(A).

In the preceding preferred embodiments described above, the recording apparatus is provided with the cleaning apparatus 110 which cleans the ink jetting surface 2 by moving the absorbent member 54 in contact with the ink jetting surface 2, in the direction in which the ink jetting openings are arranged. The absorbent member 54 is made up of multiple absorbent sections 54*a*, 54*b*, and 54*c* (or 54*h*, 54*i*, and 54*j*), which are different in average pore diameter and are joined in a line. Further, the recording apparatus is structured so that when cleaning the ink jetting surface 2, the absorbent section 54*b* (or 54*i*) of the absorbent member 54, which are larger in average pore diameter, is placed in contact with the ink jetting openings 2*a*, and their adjacencies, of the ink jetting surface 2 to absorb ink.

In the recording apparatus structured as described above, as the absorbent roller 54 is moved in contact with the ink jetting surface 2, the ink on the ink jetting surface 2 is absorbed first into the absorbent section 54*b* (or 54*i*) of the absorbent member 54, which is larger in average pore diameter. Then, the absorbed ink is absorbed into the absorbent sections 54*a* and 54*c* (or 54*h* and 54*j*) of the absorbent member 54, which are in contact with the absorbent section 54*b* (or 54*i*) of the absorbent member 54, which are smaller in average pore diameter than the section 54*b* (or 54*i*), being therefore stronger in capillary force than the absorbent section 54*b* (or 54*i*). As a result, the absorbent section 54*b* (54*i*) of the absorbent member 54 is reduced in the amount of the ink therein, being thereby restored in ink absorbency by the amount proportional to the amount by which the ink therein is reduced. Therefore, when removing the ink having adhered to the ink jetting surface of the recording apparatus, by absorbing the ink, the ink absorption performance of the absorbent member is kept at a satisfactory level for efficiently removing the ink by absorbing it.

Incidentally, the present invention is applicable to various recording apparatuses regardless of the recording head structure, scanning method, recording head count, arrangement of the ink jetting openings of the ink jetting surface, ink type, ink count, ink characteristics, etc., as effectively as it is to the recording apparatuses in the preceding embodiments described above.

According to the preferred embodiments of the present invention, the absorbent member is made up of multiple absorbent sections which are different in average pore diameter and are joined in a single line. Further, the recording apparatus is structured so that the absorbent section of the absorbent member, which is larger in average pore diameter than the rest, is placed in contact with the ink jetting openings, and its adjacencies, of the ink jetting surface to remove the ink having adhered to the adjacencies of the ink jetting openings, by absorbing the ink. Therefore, when removing the ink having adhered to the ink jetting surface of the recording head, by the absorbent member, the ink absorption performance of the absorbent member is kept at a satisfactory level for efficiently removing the ink by absorbing it.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 323900/2005 filed Nov. 8, 2005 which is hereby incorporated by reference.

What is claimed is:

1. An ink jet recording apparatus for effecting recording on a recording material by ejecting ink from an array of ejection outlets provided in an ejection side surface of a recording head, comprising:

a cleaning mechanism, including an absorbing member for absorbing and removing the ink deposited on the ejection side surface, for cleaning the ejection side surface by moving the absorbing member, which is in contact with the ejection side surface, in a direction in which the array of the ejection outlets extends;

wherein the absorbing member comprises a plurality of absorbing materials having average pore sizes different from each other and in contact with each other, and wherein an absorbing material having a larger average pore size contacts the ejection outlet to absorb the ink.

2. An apparatus according to claim 1, wherein the absorbing materials are porous and have an ink absorption property.

3. An apparatus according to claim 1, wherein the absorbing member is in the form of an absorbing material roller having a laminated structure.

4. An apparatus according to claim 1, wherein the absorbing member includes block-like absorbing materials which are laminated.

5. An apparatus according to claim 1, wherein said cleaning mechanism includes a wiper for wiping the ink out of the ejection side surface.

6. An apparatus according to claim 5, wherein the absorbing member contacts the ejection side surface prior to the wiper.

7. An apparatus according to claim 1, wherein the recording head includes a plurality of arrays of ejection outlets, arranged in parallel in the ejection side surface, and the absorbing material having a larger average pore size contacts a plurality of the ejection outlets to absorb the ink.

* * * * *